United States Patent [19]

Barker

[11] 4,453,482

[45] Jun. 12, 1984

[54] RESILIENT MAST HINGE

[75] Inventor: Milton T. Barker, High Point, N.C.

[73] Assignee: AMF Inc., White Plains, N.Y.

[21] Appl. No.: 334,718

[22] Filed: Dec. 28, 1981

[51] Int. Cl.[3] ..... B63B 15/00

[52] U.S. Cl. ..... 114/93; 114/89; 114/90; 114/91; 114/98; 16/280; 16/DIG. 33; 16/DIG. 36

[58] Field of Search ..... 114/89, 90, 91, 93, 114/97, 98; 267/154; 16/227, 280, 293, 386, DIG. 13, DIG. 33, DIG. 36

[56] References Cited

U.S. PATENT DOCUMENTS

| | | | |
|---|---|---|---|
| 270,358 | 1/1883 | Aldrich | 114/90 |
| 2,981,970 | 5/1961 | Nayes et al. | 16/280 |
| 3,311,946 | 4/1967 | Crankshaw | 267/154 |
| 3,336,021 | 8/1967 | Kramer | 267/154 |
| 3,507,240 | 4/1970 | Butler | 114/90 |
| 4,016,823 | 4/1977 | Davis | 114/90 |

*Primary Examiner*—Trygve M. Blix
*Assistant Examiner*—Rodney Corl
*Attorney, Agent, or Firm*—David E. Dougherty; Walter R. Pfluger, Jr.

[57] ABSTRACT

A radar loaded, hollow yacht mast is disclosed which is pivoted at the bottom to the deck by a tri-sectioned elastomeric torsion spring hinge assembly in which the torsion is produced by relative rotation between the inner section and the two outer sections. The torsional resistance of the hinge assembly prevents the mast from falling when the bolts and stays are removed and the restoring force in the spring elastomer when the mast is pivoted flat to the deck assists in raising the mast back into its upright position. A hollow, flanged mounting connecting the hollow mast to the movable section of the hinge assembly prevents sea water from entering the hollows. Provisions are provided for pre-loading the hinge spring with a torsional stress in either direction when the hinge is closed.

3 Claims, 3 Drawing Figures

RESILIENT MAST HINGE

This invention relates to a hinged mast, and more particularly, to a resilient mast hinge.

Although not necessarily restricted thereto, the invention is particularly useful in the marine area where not infrequently a ship or boat mast must be lowered. In travelling along the coast or inland waterways a ship or boat must frequently pass under bridges, elevated road ways, and the like. Sometimes, if the ship mast is too high and the bridge is not of the type which can be raised it is necessary to be able to quickly lower the mast in order to pass under the bridge. If the mast is to be lowered, the ship's overall height is reduced to clear the bridge. Other times it may be necessary to bring the ship or boat into a boat house or dockside shed having limited headroom. This can be done only by taking the mast down. Additionally, not infrequently ship masts have a load thereon, such as radar gear. Sometimes it is necessary to service this gear, and this would be facilitated if it were possible to lower the mast with the gear thereon. However, prior art ship or boat masts have shortcomings with respect to the above in that typically they have permanent installations or are such that they can not be readily lowered and raised.

It is an object of this invention to overcome the shortcomings and disadvantages of the just described prior art by providing an improved mast hinge which will make it easy and safe to lower the mast and then re-raise it.

It is a further object of the invention to provide a low cost mast hinge which will counterbalance the weight thereof to assist in lowering and raising the same.

Briefly, in the preferred form of the invention the lower end of a weighted mast is hinged in rubber. When the mast is hinged down the rubber is distorted to counterweight the mast so that it can't come down too fast. When raising the mast the distorted rubber acts to lift the mast to raised position.

The invention will be best understood by considering the attached single sheet of patent drawing with the ensuing detailed description. In the drawing.

Figure 1:
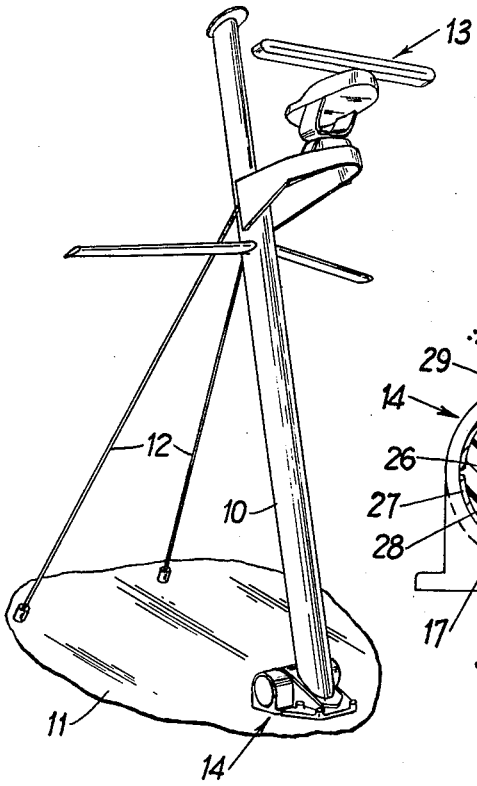
FIG. 1 is a perspective illustration of a preferred form of the invention.

Turning first to FIG. 1, shown therein is a mast 10 mounted on the cabin roof or flying bridge deck surface 11 of a not shown yacht or the like. The mast is supported in raised position and against whipping by stays, struts or the like 12. Mounted on the mast is operating structure or gear 13, which can comprise radar equipment weighing as much as 150 lbs. or more. Occasionally it is necessary to service the equipment 13. In order to do this one must either climb the mast, disconnect the equipment 13 and lower it, or bring the mast down. In my invention I make it easy to bring the mast down and re-raise it for this purpose and also to clear low bridges and the like by providing a resilient hinge 14 at the bottom of the mast. The hinge 14 has a permanent or fixed mounting on the surface 11 but permits relatively easy, slow and safe down swinging and raising of the mast.

Figure 2:
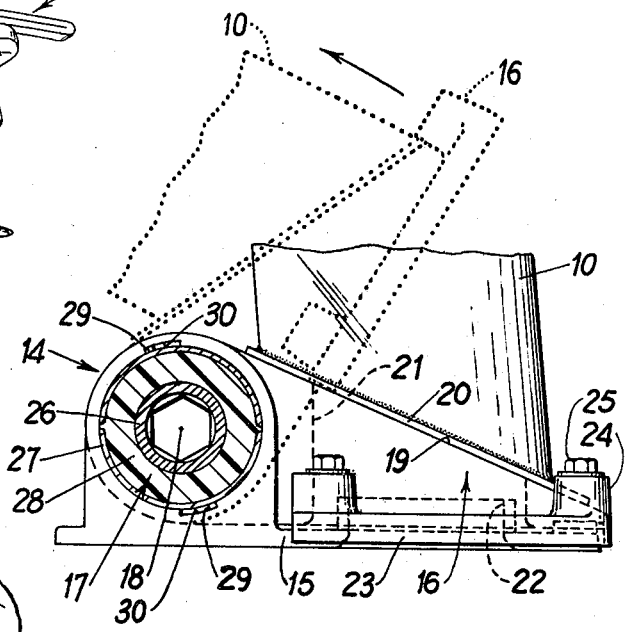
FIG. 2 is an enlarged broken away side elevation of the resilient mast hinge.
Figure 3:
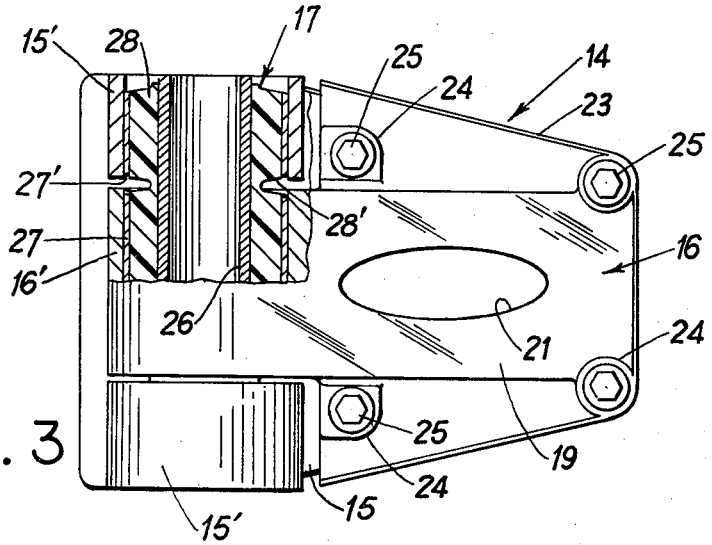
FIG. 3 is an enlarged broken away top plan view of the resilient mast hinge. Like reference numerals will be used throughout the various Figures to indicate like parts.

The details of the resilient mast hinge 14 are shown in FIGS. 2 and 3, the solid lines in FIG. 2 showing the position of the parts in mast raised position, and the dotted lines illustrate the mast down position. The resilient hinge essentially comprises three main parts, a bottom hinge leaf 15, a top hinge leaf 16, and a resilient subassembly 17 hinging the two leafs to each other. The subassembly 17 is the equivalent of a resilient hinge pin for the two leafs.

In hinged closed position the top leaf 16 which is in the form of a flanged inverted channel overlies the bottom leaf 15. The right hand or free ends of the two leaves up to their respective hinge bearings 16' and 15' have a generally isosceles trapezoidal outline as shown in FIG. 33. The bottom leaf 15 has a fixed mounting to the mast support surface 11 shown in FIG. 1 by suitable not shown means such as screws, studs, clamps or the like. At its left hand or hinged end the bottom leaf 15 has a pair of spaced apart integral hinge bearings 15'. The top leaf has a central integral hinge bearing 16' which is positioned between the other two, all three bearing being aligned with each other on a common hinge axis 18.

The top leaf 16 has a central hollow raised portion with top surface 19 which slopes down left to right. In the particular arrangement shown, the two leaves and the mast are constructed from metal. A flange 20 is welded or otherwise secured to the bottom end of the mast and the mast is secured in upright position on the top leaf 16 by resting the flange 20 on the sloped surface 19 and fixing the two together by not shown means such as screws, studs, welding, or the like. The mast 10 is hollow and a flanged opening 21 in the surface 19 is aligned with the hollow inside the mast. A flanged opening 22 is also formed in the bottom leaf 15 beneath the opening 21 in alignment therewith. The openings 21 and 22 are for the purpose of bringing electrical lines connected to the radar gear 13 down through the mast 10 and the openings 21, 22 into the control room or the like of the ship. A not shown opening in the surface 11 will have been preformed for this purpose. A seal can be positioned between the bottom hinge 15 and surface 11 to prevent water from reaching the hole in the surface 11. The flanged opening 22 in the bottom leaf is raised so that if any water gets between the two leafs it will not enter the control room.

The perimeter of the right hand end of top leaf 16 has a continuous skirt or depending lip 23. This lip or skirt 23 surrounds the perimeter of the right hand end of the bottom leaf when the top leaf is closed on the bottom one for the purpose of keeping water from splashing in between the two closed leaves. The flanged portions of the leaf 16 alongside the raised central portion 19, which are like integral lateral flat wings or webs on the portion 19, have four integral apertured bosses 24 formed thereon which register with not shown apertures formed in the bottom leaf 15. This is for the purpose of screwing studs 25 into the registering apertures in the top and bottom leafs to hold the hinge secure in shut or closed position after the mast is hinged to upright position.

The resilient hinge or pivot means 17 at the bearing end 15', 16' of the hinge will now be described. This pivot means or subassembly 17 is described in detail in B. F. Goodrich Company Kramer U.S. Pat. No. 3,336,021 (1967) and can be obtained from that company under their designation "Torsilastic" Spring. The size and characteristics of the subassembly 17 will be supplied in accordance with the load to be handled and the degrees of windup, with adequate safety margins and long life to withstand the rigors of intended use.

Briefly, the subassembly 17 comprises an inner shaft 26 which is in the form of a hollow tube, a split outer tube, cylinder, or shell 27, and an intervening mass of rubber 28 adhered to the outer surface of tube 26 and the inner surface of tube 27, see FIG. 2. The outer tube 27 and mass of rubber 28 are split or divided into a distinct central and pair of end parts which correspond to the central bearing 16' and pair of end bearings 15', see FIG. 3. The gaps between the central and end parts of the outer sleeve 27 and central rubber 28 are indicated in FIG. 3 by reference numerals 27' and 28' respectively.

In FIG. 2 keys 29 are shown as being formed on the top and bottom of the three parts of outer shell 27. Each key is positioned in a keyway 30 formed in the three bearing parts 15', 16', 15'. Each keyway 30 is oversize with respect to the key 29 in the two end bearings 15' but not the central bearing 16' for a purpose to be described hereinafter. Suffice to say at this point, upon driving not shown shims into the oversize end bearing keyways the central part of shell 27 is locked to the central hinge bearing 16' and the end parts of shell 27 are locked to the end hinge bearings 15'.

The above described structure operates in the following manner. Assuming it is desired to lower the mast, the stays 12 and studs 25 are first removed. At this point the mast will not come toppling down, because the resistance to torsion of the mass of rubber 28 serves as a counterweight or balance. When it is desired to swing the mast down, the parts move from the position shown in solid lines in FIG. 2 to the dotted line position. As the mast is swung, hinged, or pivoted to the left or counterclockwise, the hinge part 16' turns the central part of outer shell 27 with it because these two parts are keyed together. As the central part of the outer shell 27 turns it distorts or winds up the central mass of the rubber 28. Such torsional stressing of the central part of the rubber causes the tube 26 to turn counterclockwise. As tube 26 turns counterclockwise it torsionally stresses the two end parts of the rubber 28 because the end parts of the outer shell 27 are NOT free to turn because they are LOCK keyed to the stationary END bearings 15', keeping in mind that the annular mass of rubber 28 is adhered at its outer and inner surface to the inner surface of the shell parts 27 and the outersurface of the tube shaft 26. Thus, when the mast is moved from right to left the annular mass of rubber 28 is being torqued. That is to say energy is being stored therein, comparable to the foot pounds of torque corresponding to the height of the mast and its weight and the load thereon. Since distortion of the rubber resists movement of the mast it will not come crashing down to the left when the stays 12 and studs 25 are released. Rather, the mast is movable to the left but in a slow controlled manner, and the energy stored in the distorted mass of rubber will be useful when re-raising the mast with its weight or load thereon.

In bringing the mast down a rope or line can be looped around the upper end thereof. Pulling on the line will bring the mast down, but slowly, since the rubber 28 has to be stressed. After the mast is brought down to its desired angle or position it is lashed down. The energy stored in the mass of rubber 28 when the mast was torqued to the left against the resistance to distortion of the rubber is used to in effect raise the mast so that it is not necessary to use a hoist or the like to do the same. In other words, the distorted mass of rubber unwinds to help raise the mast. After the mast is righted or nearly so the line can be pulled to the right to seat the leaf 16 snug on the leaf 15, the studs 25 tightened down, and the stays 12 put back in place.

If desired, the position and condition of the subassembly 17 with respect to the bearings 15', 16' can be adjusted so that the mass of rubber 28 puts no load on the mast when it is upright. However, it is possible to preload or predistort the rubber so that when the stays 12 and studs 25 are released the hinge will automatically move to part open position, or to preload or predistort the rubber in an opposite sense so that when the two leaves are closed on each other they are under load. The latter condition will be described since it is desirable to have the two leafs shut closed on each other with some residual force when the mast is upright. This condition is obtained by proper positioning of the keys 29 in the keyways 30 of the bearings 15' and turning of the shaft 26 in the proper direction to preload or predistort the rubber so that it wants to move the mast 10 to the right even after the hinge is closed.

Heretofore it was stated that the keyway 30 in bearing 16' is just large enough to receive the key 29 on the central part of shell 27 whereas the keyway 30 in the bearings 15' is oversize with respect to the keys 29 on the end parts of shell 27. FIG. 2 illustrates the no preload position wherein all the keys 29 at top and bottom are aligned with each other. In order to preload the mast to the right or clockwise the end keys 29 in the oversize keyways 30 in the end bearings 15' must be shifted from the position shown in FIG. 2 to the opposite sidewalls of the enlarged end keyways 30. In order to facilitate doing this the inside of inner tube 26 is given a hexagonal shape, as shown, so that a hexagonal tool can be inserted into the opposite ends thereof to crank the inner tube 26 clockwise. When this is done the end keys 29 only, at top and bottom of both end bearings 15' are shifted to the opposite sidewalls of their enlarged keyways 30 from the position of the parts shown in FIG. 2. Blocking of the end keys 29 in such shifted position by suitable shims inserted behind the shifted keys will leave the subassembly prestressed so that there's a preload on the central keys 29 to move the central bearing 16' still further beyond the leaf closed position. Therefore, the hinge is fully closed but with an additional closing force imposed thereon.

Although there has been shown and described one form of the invention, it will be understood by those skilled in the art that the true scope of the invention is not necessarily restricted to the exact illustrated form thereof. For example, the positions of the keys and keyways 29, 30 could be reversed, other resilient bearings could be used and the single central bearing 16' could be formed on the stationary leaf 15 and the pair of end bearings 15' on the movable leaf 16.

It will now be clear that my invention provides a novel way of lowering and raising masts, or other poles. This is accomplished by providing a resilient hinge at the bottom mounting end of the mast or pole, which resilient hinge operates as a counterweight when bringing the mast down and therefor assists in raising the mast. In addition, the resilient hinge is adapted to be adjusted for preloading the mast to hinge closed position, and the resilient hinge is relatively uncomplex, having a relatively small number of parts which can be readily obtained or fabricated and assembled together and to the mast.

I claim:

1. A resilient bottom hinge for the lower end of a marine mast, said hinge comprising a pair of superposed hinge leafs which are pivoted together at one of their corresponding ends by a mass of rubber, a hollow mast mounted on the top leaf, apertures formed in the corresponding free ends of said leafs which are aligned with the hollow in said mast for facilitating bringing electrical wires down through said mast and hinge, the aperture in the bottom leaf being surrounded by a raised flange, and the outline of the free end of said bottom leaf being followed by a depending flange on the top leaf, said flanges being operative to prevent water from obtaining access to the aperture in the bottom leaf.

2. A foldable deck mast comprising a three sectioned torsion spring hinge assembly for carrying a load transverse to the longitudinal axis of the hinge in which torsional resistance is produced by relative rotation between the inner section and the two outer sections; two hinge leaves, one affixed to the hinge inner section, the other to the two outer sections, the mast being affixed to one leaf, the deck to the other, the mast affixed hinge leaf having an inverted channel structure supporting the mast, flanges extending from each channel leg to cover the deck hinge leaf and means for removably fastening the two leaves together, whereby the rotation of the mast down toward the deck winds up the spring against its torsional resistance and the restoring force of the wound up spring assists in unfolding the mast into the upright position.

3. A foldable deck mast according to claim 2 in which the mast is hollow, the deck affixed hinge leaf has an aperture extending between the legs of the channel and aligned with the mast hollow to provide a continuous passage through the mast hollow and both hinge leaves.

* * * * *